US011952546B2

(12) United States Patent
Mondkar et al.

(10) Patent No.: US 11,952,546 B2
(45) Date of Patent: Apr. 9, 2024

(54) HYDROGEN SULPHIDE AND MERCAPTANS SCAVENGING COMPOSITIONS

(71) Applicant: TOTAL MARKETING SERVICES, Puteaux (FR)

(72) Inventors: Hemant Surendra Mondkar, Maharashtra (IN); Frédéric Tort, Brignais (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 17/297,549

(22) PCT Filed: Dec. 4, 2019

(86) PCT No.: PCT/EP2019/083679
§ 371 (c)(1),
(2) Date: May 27, 2021

(87) PCT Pub. No.: WO2020/115132
PCT Pub. Date: Jun. 11, 2020

(65) Prior Publication Data

US 2022/0041944 A1 Feb. 10, 2022

(30) Foreign Application Priority Data

Dec. 4, 2018 (IN) ..... 201841045739
Jan. 17, 2019 (EP) ..... 19305059

(51) Int. Cl.

| | |
|---|---|
| ***C10L 1/18*** | (2006.01) |
| ***C10G 29/20*** | (2006.01) |
| ***C10L 1/22*** | (2006.01) |
| ***C10L 1/233*** | (2006.01) |
| ***C10L 1/2383*** | (2006.01) |
| ***C10L 3/10*** | (2006.01) |

(52) U.S. Cl.
CPC ..... *C10L 1/233* (2013.01); *C10G 29/20* (2013.01); *C10L 1/2383* (2013.01); *C10L 3/103* (2013.01); *C10L 2300/20* (2013.01)

(58) Field of Classification Search
CPC ..... C10L 1/18; C10L 1/22; C10L 1/221
See application file for complete search history.

(56) References Cited

U.S. PATENT DOCUMENTS

| | | | | |
|---|---|---|---|---|
| 4,391,925 | A * | 7/1983 | Mintz | C09K 8/502 507/120 |
| 4,569,766 | A | 2/1986 | Kool et al. | |
| 4,873,006 | A * | 10/1989 | Vinci | C10M 163/00 508/567 |
| 6,117,310 | A * | 9/2000 | Rivers | C10L 3/10 585/860 |
| 6,786,940 | B1 | 9/2004 | Wenderoth | |
| 8,187,345 | B2 | 5/2012 | Eisenbeis | |
| 8,668,749 | B2 * | 3/2014 | Fang | C07D 213/55 44/418 |
| 2011/0048354 | A1 * | 3/2011 | Hollingshurst | C09K 23/002 44/422 |
| 2013/0004393 | A1 * | 1/2013 | Menendez | B01D 53/52 210/749 |
| 2015/0151240 | A1 | 6/2015 | Laroche | |
| 2016/0175769 | A1 * | 6/2016 | Kamoun | B01D 53/52 252/189 |
| 2017/0121443 | A1 | 5/2017 | Reddy | |
| 2018/0371334 | A1 | 12/2018 | Beilfuss | |

FOREIGN PATENT DOCUMENTS

| | | | |
|---|---|---|---|
| FR | 3057877 | | 4/2018 |
| RU | 1786041 | | 1/1993 |
| RU | 2290427 | | 12/2006 |
| RU | 2418036 | | 5/2010 |
| RU | 2510615 | | 5/2011 |
| WO | WO1998002501 | * | 1/1998 |

* cited by examiner

*Primary Examiner* — Ellen M McAvoy
*Assistant Examiner* — Ming Cheung Po
(74) *Attorney, Agent, or Firm* — DUANE MORRIS LLP; Gregory M. Lefkowitz; Brandon A. Chan

(57) ABSTRACT

The present invention relates to a composition for scavenging hydrogen sulphide and/or mercaptans in hydrocarbon streams, the composition comprising an oxazolidine compound and a synergistic additive.

16 Claims, No Drawings

HYDROGEN SULPHIDE AND MERCAPTANS SCAVENGING COMPOSITIONS

CROSS-REFERENCE TO RELATED APPLICATIONS

This application is a § 371 national stage entry of International Application No. PCT/EP2019/083679, filed Dec. 4, 2019, which claims priority to Indian Patent Application No. 201841045739 filed Dec. 4, 2018, and European Patent Application No. 19305059.8, filed Jan. 17, 2019, the entire contents of which are incorporated herein by reference.

TECHNICAL FIELD

The present invention pertains to a novel hydrogen sulphide and mercaptans scavenging composition comprising an oxazolidine compound and a specific additive. The present invention also pertains to the use of the additive to improve the efficiency of an oxazolidine compound for scavenging hydrogen sulphide and mercaptans in hydrocarbon streams. The present invention also relates to a method for scavenging hydrogen sulphide and/or mercaptans comprising contacting a hydrocarbon stream such as crude oil, fuel or natural gas with the scavenging composition of the invention.

BACKGROUND OF THE INVENTION

Hydrogen sulphide is a colourless and fairly toxic, flammable and corrosive gas which also has a characteristic odour at a very low concentration. Hydrogen sulphide dissolves in hydrocarbon and water streams and is also found in the vapour phase above these streams and in natural gas. The hydrogen sulphide emissions can therefore be a nuisance to workers operating in the drilling, production, transport, storage, and processing of crude oil and in the storage of fuel. Hydrogen sulphide may also react with hydrocarbon components present in fuel. It would therefore be desirable for the workers' comfort and safety to reduce or even eliminate the hydrogen sulphide emissions during the manipulation of said products.

Legislation has been in place for years, imposing strict regulations on hydrogen sulphide levels of hydrocarbon streams pipelines, and in storage and shipping containers. A variety of chemical scavengers are available to reduce both the concentration and corresponding hazard of hydrogen sulphide in produced gas, crude oil and refined products. Some of the most common methods for treating hydrogen sulphide include triazine, glyoxal, as well as metal-based scavengers. Glyoxal has been used extensively as hydrogen sulphide scavenger but suffers from a major drawback since aqueous glyoxal solutions are highly corrosive and cannot be used for a gas tower application. Triazines have recently become a more common chemical scavenger used for treating hydrogen sulphide from hydrocarbon streams. However, many drawbacks are reported that are linked to the use of triazines.

Others hydrogen sulphide scavengers have been developed, and among them scavengers based on oxazolidine, like 3,3'-methylenebis(5-methyloxazolidine), known as MBO. A method for scavenging hydrogen sulphide from sour hydrocarbon substrates has been described in WO 98/02501. MBO presents the advantage to be less toxic and to create no scales in the conditions where triazine does.

However, this technology requires an important contact time in order to be efficient in sulphur removal and thus involves injection of higher doses.

Formulations of MBO with promoters, also named boosters, have been developed to enhance the efficiency of MBO. For example, WO 2017/102693 describes a composition comprising MBO and one or more additive selected among urea, urea derivatives, amino acids, guanidine, guanidine derivatives or 1,2-diols, said composition being used in the removal of sulphur compounds from process streams.

It would be useful to provide a composition enhancing the $H_2S$ scavenging properties of MBO.

SUMMARY OF THE INVENTION

The present invention relates to a composition for scavenging hydrogen sulphide and mercaptans in hydrocarbon streams, said composition comprising an oxazolidine compound and an additive, the additive being the reaction product of a compound (A) with a compound (B), optionally followed by a quaternization reaction of the reaction product of (A) and (B) with a compound (C), wherein:

Compound (A) is a hydrocarbyl-substituted acylating agent,

Compound (B) is a nitrogen-containing compound selected from primary, secondary or tertiary polyamines and a compound comprising at least one tertiary amine group and at least one group selected from the primary and secondary amines or the alcohols, Compound (C) is a quaternizing agent.

According to a particular embodiment, the hydrocarbyl-substituted acylating agent (A) is selected from the mono- or polycarboxylic acids substituted with a hydrocarbon group and their derivatives, alone or in a mixture.

According to a particular embodiment, the compound (A) is selected from the succinic, phthalic and propionic acids substituted with a hydrocarbon group, preferably is a polyisobutenyl succinic anhydride (PIBSA).

According to a particular embodiment, the compound (B) is selected from primary polyamines, preferably of formula (II):

$$H_2N—[(CHR^3—(CH_2)_p—CHR^4)_q—NH]_m—H$$

wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1.

According to a particular embodiment, the compound (B) is selected from the group consisting of: N,N-dimethylaminopropylamine, N,N,N-tris(aminoethyl)amine, N,N-dibutylaminopropylamine, N,N-diethylaminopropylamine, N,N-dimethylaminoethylamine, 1-(3-aminopropyl)imidazole, 4-(3-aminopropyl) morpholine, 1-(2-aminoethyl)piperidine, 3,3-diamino-N-methyldipropylamine, and 3'3-bisamino(N,N-dimethylpropylamine), N'-(3-(dimethylamino)propyl)-N,N-dimethyl-1,3-propanediamine, and alkanolamines, such as alkanolamine comprising one hydroxyl function, one primary amine function and one tertiary amine function and comprising preferably from 4 to 16 carbon atoms, more preferably from 6 to 12 carbon atoms.

According to a particular embodiment, the quaternizing agent (C) is selected from the group constituted by the dialkyl sulphates, the carboxylic acid esters; the alkyl halides, the benzyl halides, the hydrocarbon carbonates, and the hydrocarbon epoxides optionally mixed with an acid, alone or in a mixture.

According to a particular embodiment, the additive comprises:

(i) the reaction product of a compound (A) with a compound (B), wherein:

Compound (A) is a polyisobutenyl succinic anhydride (PIBSA),

Compound (B) is a nitrogen-containing compound formula (II):

$$H_2N—[(CHR^3—(CH_2)_p—CHR^4)_q—NH]_m—H$$

Wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1, or (ii) the reaction product of a compound (A) with a compound (B), followed by a quaternization reaction of the reaction product of (A) and (B) with a compound (C), wherein:

Compound (A) is a a polyisobutenyl succinic anhydride (PIBSA),

Compound (B) is an alkanolamine comprising one hydroxyl function, one primary amine function and one tertiary amine function and from 4 to 16 carbon atoms, Compound (C) is a quaternizing agent.

According to a particular embodiment, the composition comprises from 19 to 99% wt of oxazolidine compound(s) and from 1 to 50% wt of said additive(s), based on the total weight of the composition.

According to a particular embodiment, the weight ratio of oxazolidine compound(s) to said additive(s) ranges from 1 to 50, preferably from 2 to 30, preferably from 4 to 20.

According to a particular embodiment, the composition further comprising a solvent, preferably in an amount ranging from 1 to 80% wt, based on the total weight of the composition.

According to a particular embodiment, the composition comprises:

From 19 to 80% wt of oxazolidine compound(s),

From 1 to 30% wt of said additive(s), and

From 1 to 80% wt of solvent(s), based on the total weight of the composition.

The present invention also relates to a use of the additive for improving the efficiency of an oxazolidine compound for scavenging hydrogen sulphide and/or mercaptans in hydrocarbon streams.

The present invention also relates to a hydrocarbon stream comprising hydrocarbons and a composition according to the invention.

According to a particular embodiment, the hydrocarbons are selected from crude oil, fuel oil, fuel, Light Petroleum Gas and natural gas.

The present invention also relates to a method for scavenging hydrogen sulphide and/or mercaptans in hydrocarbon streams, comprising contacting the hydrocarbon stream with the composition according to the invention.

The composition of the present invention enables to reduce the treat rate, i.e. reduce the amount of MBO necessary to scavenge a given amount of hydrogen sulphide from the sulphur containing stream.

DETAILED DESCRIPTION OF THE INVENTION

The present invention concerns a hydrogen sulphide and mercaptans scavenging composition comprising at least one oxazolidine compound and at least one additive.

According to the present invention, the additive comprises the reaction product of a compound (A) with a compound (B), optionally followed by a quaternization reaction of the reaction product of (A) and (B) with a compound (C), wherein:

Compound (A) is a hydrocarbyl-substituted acylating agent,

Compound (B) is a nitrogen-containing compound selected from primary, secondary or tertiary polyamines and a compound comprising at least one tertiary amine group and at least one group selected from the primary and secondary amines or the alcohols, Compound (C) is a quaternizing agent.

According to a particular embodiment, the oxazolidine compound is selected from bisoxazolidines, i.e. compounds comprising two oxazolidine cycles.

According to a particular embodiment, the oxazolidine compound replies to formula (I):

(I)

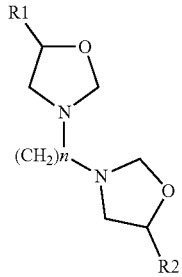

wherein n is an integer ranging from 1 to 6, preferably from 1 to 2;

R1 and R2, identical or different, are selected from a hydrogen atom and a linear, branched or cyclic alkyl or alkenyl groups having from 1 to 6 carbon atoms, preferably from 1 to 2 carbon atoms.

Preferably, the oxazolidine compound is 3,3'-methylenebis(5-methyloxazolidine).

The additive of the invention comprises the reaction product of a compound (A) with a compound (B), optionally followed by a quaternization reaction of the reaction product of (A) and (B) with a compound (C), wherein:

Compound (A) is a hydrocarbyl-substituted acylating agent,

Compound (B) is a nitrogen-containing compound selected from primary, secondary or tertiary polyamines and a compound comprising at least one tertiary amine group and at least one group selected from the primary and secondary amines or the alcohols, Compound (C), which is optionally used, is a quaternizing agent.

According to the invention, the "additive" used in combination with the oxazolidine compound is also referred to by the expression the "synergistic additive". Preferably, the additive or synergistic additive comprises:

(i) the reaction product of a compound (A) with a compound (B), wherein:

Compound (A) is a hydrocarbyl-substituted acylating agent,

Compound (B) is a nitrogen-containing compound selected from primary, secondary or tertiary polyamines, or (ii) the reaction product of a compound (A) with a compound (B), followed by a quaternization reaction of the reaction product of (A) and (B) with a compound (C), wherein:

Compound (A) is a hydrocarbyl-substituted acylating agent,

Compound (B) is a nitrogen-containing compound comprising at least one tertiary amine group and at least one group selected from the primary and secondary amines or the alcohols, Compound (C) is a quaternizing agent.

According to the present invention, the hydrocarbyl-substituted acylating agent may be selected from the mono- or polycarboxylic acids substituted with a hydrocarbon group and their derivatives, alone or in a mixture. The acylating agent is, for example, selected from the succinic, phthalic and propionic acids substituted with a hydrocarbon group.

By "hydrocarbon" group is meant any group having a carbon atom attached directly to the rest of the molecule and mainly having an aliphatic hydrocarbon character. Hydrocarbon groups according to the invention may also contain non-hydrocarbon groups. For example, they may contain up to one non-hydrocarbon group per ten carbon atoms provided that the non-hydrocarbon group does not significantly alter the mainly hydrocarbon character of the group. We may mention, as examples of such groups that are well known to a person skilled in the art, the hydroxyl groups, the halogens (in particular the chloro and fluoro groups), the alkoxy, alkylmercapto, and alkylsulphoxy groups.

Nevertheless, the hydrocarbon substituents not containing such non-hydrocarbon groups, and having a purely aliphatic hydrocarbon character, will be preferred. The hydrocarbon substituent of the acylating agent is preferably essentially saturated, i.e. it does not contain more than one unsaturated carbon-carbon bond for each section of ten carbon-carbon single bonds present. The hydrocarbon substituent of the acylating agent advantageously contains not more than one non-aromatic unsaturated carbon-carbon bond to every 50 carbon-carbon bonds present.

The hydrocarbon substituent of the acylating agent preferably comprises at least 8, preferably at least 12 carbon atoms, for example between 30 or 50 carbon atoms. Said hydrocarbon substituent may comprise up to approximately 200 carbon atoms. The hydrocarbon substituent of the acylating agent preferably has a number-average molecular weight (Mn) comprised between 170 and 2800, for example between 250 and 1500, more preferably between 500 and 1500, and even more preferably between 500 and 1100. A range of values of Mn comprised between 700 and 1300 is particularly preferred, for example from 700 to 1000.

According to a preferred particular embodiment, the hydrocarbon substituent of the acylating agent is preferably selected from the polyisobutenes known in the prior art. Advantageously, the acylating agent substituted with a hydrocarbyl group is a polyisobutenyl succinic anhydride (PIBSA). The preparation of polyisobutenyl succinic anhydrides (PIBSA) is widely described in the literature. The methods comprising the reaction between polyisobutenes (PIB) and maleic anhydride described in U.S. Pat. Nos. 3,361,673 and 3,018,250 or the process comprising the reaction of a halogenated, in particular chlorinated, polyisobutene (PIB) with maleic anhydride (U.S. Pat. No. 3,172,892) may be mentioned by way of example.

According to a variant, the polyisobutenyl succinic anhydride may be prepared by mixing a polyolefin with maleic anhydride and then passing chlorine through the mixture (GB949 981). In particular, the polyisobutenes (PIBs) referred to as highly reactive will be used. By "highly reactive polyisobutenes (PIBs)" is meant polyisobutenes (PIB) in which at least 50%, preferably at least 70% or more, of the terminal olefinic double bonds are of the vinylidene type as described in document EP0565285. In particular, the preferred PIBs are those having more than 80 mol % and up to 100 mol % of terminal vinylidene groups as described in document EP1344785.

Other hydrocarbon groups comprising an internal olefin, for example such as those described in application WO2007/015080, may also be used. Internal olefin means any olefin mainly containing a non-alpha double bond, which is a beta olefin or with a higher position. Preferably, these materials are essentially beta-olefins or olefins of higher position, for example containing less than 10% by mass of alpha-olefin, advantageously less than 5% by mass or less than 2% by mass. The internal olefins may be prepared by isomerization of alpha-olefins by any known process.

Preferably, the hydrocarbyl-substituted acylating agent (A) is selected from polyisobutenyl succinic anhydrides (PIBSA).

The compound (B) is a nitrogen-containing compound selected from (b1) primary, secondary or tertiary polyamines and (b2) a compound comprising at least one tertiary amine group and at least one group selected from the primary and secondary amines or the alcohols.

Preferably, (b1) is selected from primary polyamines, preferably of formula (II):

$$H_2N—[(CHR^3—(CH_2)_p—CHR^4)_q—NH]_m—H$$

Wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1.

Preferably, the compound (b2) is selected from the group consisting of: N,N-dimethylaminopropylamine, N,N,N-tris(aminoethyl)amine, N,N-dibutylaminopropylamine, N,N-diethylaminopropylamine, N,N-dimethylaminoethylamine, 1-(3-aminopropyl)imidazole, 4-(3-aminopropyl)morpholine, 1-(2-aminoethyl)piperidine, 3,3-diamino-N-methyldipropylamine, 3'3-bisamino(N,N-dimethylpropylamine), N'-(3-(dimethylamino)propyl)-N,N-dimethyl-1,3-propanediamine, and alkanolamines.

According to a preferred embodiment, the compound (b2) is selected from N,N-dimethylaminopropylamine and alkanolamines. Preferably, alkanolamines comprises one hydroxyl function, one primary amine function and one tertiary amine function and preferably comprise from 4 to 16 carbon atoms, preferably from 6 to 12 carbon atoms.

According to a preferred embodiment, the compound (b2) is selected from N,N-dimethylaminopropylamine and alkanolamines. Preferably, alkanolamines comprises one hydroxyl function, one primary amine function and one tertiary amine function and preferably comprise from 4 to 16 carbon atoms, preferably from 6 to 12 carbon atoms, the alcohol function of the alkanolamine being a primary alcohol or a secondary alcohol.

Among alkanolamines that can be used in the present invention, mention may be made of triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, and N, N,N'-trimethyl-N'-hydroxyethyl-bisaminoethyl ether, N,N-bis(3-dimethylamino-propyl)-N-isopropanolamine, N-(3-dimethylamino-propyl)-N,N-diisopropanolamine, 2-(2-dimethylaminoethoxy)ethanol, N-methyl-N'-isopropanol-1,3-propanediamine, and N,N,N'-trimethylaminoethylethanolamine.

Other examples of alkanolamines that can be used in the present invention, are 1-[(2-aminoethyl)methylamino]-2-propanol, 1-[(2-aminoethyl)ethylamino]-2-propanol, 1-[(2-aminoethyl)butylamino]-2-Propanol, 1-[(2-aminoethyl)ethylamino]-2-methyl-2-Propanol, 2-Propanol, 1-[(3-aminopropyl)methylamino]-2-Propanol, 1-[(3-aminopropyl)propylamino]-2-Propanol, 1-[bis(3-aminopropyl)amino]-2-Propanol, 1-[(3-amino-2-methylpropyl)methylamino]-2-Propanol, 1-[(3-aminopropyl)methylamino]-2-Butanol, 1,1'-[(3-aminopropyl)imino]bis-2-Propanol.

According to a particular embodiment of the invention, the compound (B) is selected from a compound of formula (II) as defined above or an alkanolamine comprising one hydroxyl function, one primary amine function and one tertiary amine function and from 4 to 16 carbon atoms.

According to an embodiment, the product of the reaction of (A) and (B) is further reacted with a quaternizing agent (C) to provide the additive used in the invention.

Preferably, the compound quaternizing agent (C) is selected from the group constituted by the dialkyl sulphates, the carboxylic acid esters; the alkyl halides, the benzyl halides, the hydrocarbon carbonates, and the hydrocarbon epoxides optionally mixed with an acid, alone or in a mixture.

For fuel applications, it is often desirable to reduce the content of halogen, sulphur and the phosphorus-containing compounds. Thus, if a quaternizing agent containing such an element is used, it may be advantageous to carry out a subsequent reaction for exchange of the counter-ion. For example, a quaternary ammonium salt formed by reaction with an alkyl halide may then be reacted with sodium hydroxide and the sodium halide salt may be removed by filtration.

The quaternizing agent may comprise halides such as chloride, iodide or bromide; hydroxides; sulphonates; bisulphites; alkyl sulphates such as dimethyl sulphate; sulphones; phosphates; $C_1$-$C_{12}$ alkyl phosphates; $C_1$-$C_{12}$ dialkyl phosphates; borates; $C_1$-$C_{12}$ alkyl borates; nitrites; nitrates; carbonates; bicarbonates; alkanoates; $C_1$-$C_{12}$ O,O-dialkyldithiophosphates, alone or in a mixture.

According to a particular embodiment, the quaternizing agent may be derived from dialkyl sulphates such as dimethyl sulphate, from N-oxides, from sulphones such as propane- and butane-sulphone, from alkyl halides, from acyl or from aralkyl such as methyl and ethyl chloride, benzyl bromide, iodide or chloride, and the alkyl carbonates. If the acyl halide is benzyl chloride, the aromatic ring is optionally substituted with one or more alkyl or alkenyl groups. The alkyl group of the alkyl carbonates may contain from 1 to 50, from 1 to 20, from 1 to 10 or 1 to 5 carbon atoms per group.

According to a particular embodiment, the alkyl carbonates contain two alkyl groups, which may be identical or different. As an example of alkyl carbonates, dimethyl or diethyl carbonate may be mentioned.

Preferably, the synergistic additive comprises:

(i) the reaction product of a compound (A) with a compound (B), wherein:
- Compound (A) is a polyisobutenyl succinic anhydride (PIBSA),
- Compound (B) is a nitrogen-containing compound formula (II):

$$H_2N—[(CHR^3—(CH_2)_p—CHR^4)_q—NH]_m—H$$

Wherein:
- $R^3$ and $R^4$, which are identical or different, represent hydrogen or an alkyl or alkenyl group comprising from 1 to 4 carbon atoms,
- q is an integer varying from 1 to 3,
- m is an integer varying from 1 to 10 and
- p is an integer equal to 0 or 1, or (ii) the reaction product of a compound (A) with a compound (B), followed by a quaternization reaction of the reaction product of (A) and (B) with a compound (C), wherein:
- Compound (A) is a a polyisobutenyl succinic anhydride (PIBSA),
- Compound (B) is an alkanolamine comprising one hydroxyl function, one primary amine function and one tertiary amine function and from 4 to 16 carbon atoms,
- Compound (C) is a quaternizing agent preferably selected from the group constituted by the dialkyl sulphates, the carboxylic acid esters; the alkyl halides, the benzyl halides, the hydrocarbon carbonates, and the hydrocarbon epoxides optionally mixed with an acid, alone or in a mixture.

According to an embodiment, the synergistic additive comprises:

(i) the reaction product of a compound (A) with a compound (B), wherein:
- Compound (A) is a polyisobutenyl succinic anhydride (PIBSA),
- Compound (B) is a nitrogen-containing compound formula (II):

$$H_2N—[(CHR^3—(CH_2)_p—CHR^4)_q—NH]_m—H$$

Wherein:
- $R^3$ and $R^4$, which are identical or different, represent hydrogen or an alkyl or alkenyl group comprising from 1 to 4 carbon atoms,
- q is an integer varying from 1 to 3,
- m is an integer varying from 1 to 10 and
- p is an integer equal to 0 or 1, or (ii) the reaction product of a compound (A) with a compound (B), followed by a quaternization reaction of the reaction product of (A) and (B) with a compound (C), wherein:
- Compound (A) is a a polyisobutenyl succinic anhydride (PIBSA),
- Compound (B) is an alkanolamine comprising one hydroxyl function, one primary amine function and one secondary amine function and from 4 to 16 carbon atoms,
- Compound (C) is a quaternizing agent preferably selected from the group constituted by the dialkyl sulphates, the carboxylic acid esters; the alkyl halides, the benzyl halides, the hydrocarbon carbonates, and the hydrocarbon epoxides optionally mixed with an acid, alone or in a mixture.

According to an embodiment, the $H_2S$ and mercaptans scavenging composition comprises from 19 to 99% wt, preferably from 40 to 98% wt, more preferably from 55 to 79%, more preferably from 60 to 95% wt, even more preferably from 70 to 90% wt of oxazolidine compound(s) and from 0.5 to 50% wt, preferably from 1 to 45% wt, even more preferably from 1.5 to 40% wt, more preferably from 2 to 30% wt of synergistic additive(s), based on the total weight of the $H_2S$ and mercaptans scavenging composition. Preferably, the weight ratio of oxazolidine compound(s) to synergistic additive(s) ranges from 1 to 100, preferably from 1 to 50, more preferably from 2 to 30, even more preferably from 4 to 20.

According to an embodiment, the $H_2S$ and mercaptans scavenging composition further comprises at least one solvent.

Preferably, the solvent is selected from poly alkyl ethers, aliphatic or aromatic solvents, such as N-methylpyrrolidone, butyl carbitol, xylene, toluene, and benzene. It has been observed that the scavenging efficiency of the compositions of the invention is not dependent on the solvent. However, depending on the final use of the scavenging composition, a solvent having a dual solubility, i.e. a water solubility and a solubility in hydrocarbons, can be preferred. Butyl carbitol is a suitable solvent since it has this dual solubility.

According to this embodiment, the solvent represents from 1 to 80% wt of the composition, preferably from 5 to 70% wt, more preferably from 10 to 60% wt, even more preferably from 20 to 50% wt of the composition.

According to a particular embodiment of the invention, the composition comprises:

From 10 to 98% wt, preferably from 30 to 80% wt, more preferably from 40 to 60% wt of oxazolidine compound(s), From 0.5 to 30% wt, preferably from 1 to 20% wt, more preferably from 2 to 15% wt, even more preferably from 3 to 10% wt of the additive(s) defined in the invention, and From 1.5 to 80% wt, preferably from 5 to 65% wt, more preferably from 15 to 55% wt of solvent(s), based on the total weight of the composition.

According to a particular embodiment of the invention, the composition comprises:

From 19 to 80% wt, preferably from 30 to 70% wt, more preferably from 40 to 60% wt of oxazolidine compound(s), From 1 to 30% wt, preferably from 1.5 to 20% wt, more preferably from 2 to 10% wt of the additive(s) defined in the invention, and From 1 to 80% wt, preferably from 15 to 65% wt, more preferably from 25 to 55% wt of solvent(s), based on the total weight of the composition.

According to an embodiment of the invention, the composition comprises:

From 19 to 80% wt, preferably from 30 to 70% wt, more preferably from 40 to 60% wt of a bisoxazolidine, From 1 to 30% wt, preferably from 1.5 to 20% wt, more preferably from 2 to 10% wt of additive(s), and From 1 to 80% wt, preferably from 15 to 65% wt, more preferably from 25 to 55% wt of solvent(s), based on the total weight of the composition, wherein the additive(s) are selected from: (i) the reaction product of a compound (A) with a compound (B), wherein:

Compound (A) is a polyisobutenyl succinic anhydride (PIBSA),

Compound (B) is a nitrogen-containing compound formula (II):

$$H_2N—[(CHR^3—(CH_2)_p—CHR^4)_q—NH]_m—H$$

Wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1, or (ii) the reaction product of a compound (A) with a compound (B), followed by a quaternization reaction of the reaction product of (A) and (B) with a compound (C), wherein:

Compound (A) is a a polyisobutenyl succinic anhydride (PIBSA),

Compound (B) is an alkanolamine comprising one hydroxyl function, one primary amine function and one tertiary amine function and from 4 to 16 carbon atoms, Compound (C) is a quaternizing agent.

According to an embodiment of the invention, the composition comprises:

From 10 to 98% wt, preferably from 30 to 80% wt, more preferably from 40 to 60% wt of bisoxazolidine compound(s), From 0.5 to 30% wt, preferably from 1 to 20% wt, more preferably from 2 to 15% wt, even more preferably from 3 to 10% wt of the additive(s) defined in the invention, and From 1.5 to 80% wt, preferably from 5 to 65% wt, more preferably from 15 to 55% wt of solvent(s), based on the total weight of the composition, wherein the additive(s) are selected from: (i) the reaction product of a compound (A) with a compound (B), wherein:

Compound (A) is a polyisobutenyl succinic anhydride (PIBSA),

Compound (B) is a nitrogen-containing compound formula (II):

$$H_2N—[(CHR^3—(CH_2)_p—CHR^4)_q—NH]_m—H$$

Wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1, or (ii) the reaction product of a compound (A) with a compound (B), followed by a quaternization reaction of the reaction product of (A) and (B) with a compound (C), wherein:

Compound (A) is a a polyisobutenyl succinic anhydride (PIBSA),

Compound (B) is an alkanolamine comprising one hydroxyl function, one primary amine function and one tertiary amine function and from 4 to 16 carbon atoms, Compound (C) is a quaternizing agent preferably selected from the group constituted by the dialkyl sulphates, the carboxylic acid esters; the alkyl halides, the benzyl halides, the hydrocarbon carbonates, and the hydrocarbon epoxides optionally mixed with an acid, alone or in a mixture.

The present invention also concerns the use of the additive defined above for improving the efficiency of the oxazolidine compound defined above for scavenging hydrogen sulphide (H2S) and/or mercaptans in hydrocarbon streams.

The "additive" used in the invention is also named the "synergistic additive", since when used in combination with an oxazolidine compound, it can boost the effect of the oxazolidine compound for scavenging H2S and/or mercaptans in hydrocarbon streams.

By hydrocarbon stream is meant either a single-phase hydrocarbon stream or a multiphase system comprising oil/water or oil/water/gas or gas/water.

Preferably, the weight ratio oxazolidine compound(s) to synergistic additive(s) ranges from 1 to 50, preferably from 2 to 30, preferably from 4 to 20.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

The present invention also concerns the use of the composition defined above as a $H_2S$ and/or mercaptans scavenger in hydrocarbon streams, said hydrocarbon streams being preferably selected from crude oil, fuel and natural gas. The composition of the invention is contacted with hydrocarbon streams such as crude oil, fuel or natural gas in order to reduce the amount of hydrogen sulphide ($H_2S$) and mercaptans. Hydrocarbon streams may be selected from crude oils and fuels which typically comprise more than 60% wt of paraffins, preferably more than 70% wt of paraffins and even more preferably more than 75% wt of paraffins, based on the total weight of the crude oils and fuels. Hence, hydrocarbon streams may be selected from crude oils and fuels which typically comprise less than 30% wt of aromatics, preferably less than 10% wt of aromatics and even more preferably less than 5% wt of aromatics, based on the total weight of the crude oils and fuels.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

According to an embodiment of the present invention, the weight ratio $H_2S$:scavenging composition ranges from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4. In this ratio, $H_2S$ represents the amount of hydrogen sulphide in the hydrocarbon streams, before contacting with the scavenging composition of the invention.

The present invention also concerns hydrocarbon streams comprising hydrocarbons and the composition of the invention. The hydrocarbon streams considered in the present invention may be either single-phase hydrocarbon streams or multiphase systems comprising oil/water or oil/water/gas or gas/water.

Hydrocarbons may be selected from crude oil, fuel oil, fuel, Light Petroleum Gas and natural gas. Hydrocarbon streams may be selected from crude oils and fuels which typically comprise more than 60% wt of paraffins, preferably more than 70% wt of paraffins and even more preferably more than 75% wt of paraffins, based on the total weight of the crude oils and fuels. Hence, hydrocarbon streams may be selected from crude oils and fuels which typically comprise less than 30% wt of aromatics, preferably less than 10% wt of aromatics and even more preferably less than 5% wt of aromatics, based on the total weight of the crude oils and fuels.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

The composition of the invention may represent from 0.0005 to 5% by weight of the total weight of the hydrocarbon streams.

According to an embodiment of the present invention, the weight ratio $H_2S$:scavenging composition ranges from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4. In this ratio, $H_2S$ represents the amount of hydrogen sulphide of the hydrocarbon streams, before contacting with the scavenging composition of the invention.

EXAMPLES

The invention is now described with the help of the following examples, which are not intended to limit the scope of the present invention, but are incorporated to illustrate advantages of the present invention and best mode to perform it. The following examples also demonstrate the effectiveness of scavenging compositions of the present invention, which can be a composition comprising MBO and a condensation product of PIBSA and primary polyamine or a composition comprising MBO (3,3'-methylenebis(5-methyloxazolidine) and a condensation product of PIBSA and alkanolamine followed by a quaternization.

Example 1: Protocol of Experiment for the Measurement of $H_2S$ Scavenging Ability of the Scavenging Compositions Under Modified ASTM D-5705 Conditions ASTM D-5705 is recommended for measurement of Hydrogen sulfide in a vapor phase above the residual fuel oils. Performance evaluation of the various products and formulations developed as Hydrogen Sulfide Scavengers were evaluated using modified ASTM D-5705 test method.

In a typical experiment, 1 liter tin metal bottles with inner and outer caps were used to prepare and hold the test media. Dearomatized hydrocarbon solvents (with high boiling range i.e. >120° C. and flash point above 65° C. with aromatic content less than 0.1%) is used for the tests.

In a representative experimental set, a defined amount of $H_2S$ saturated hydrocarbon solvent, typically between 2000 and 7000 ppm by weight of $H_2S$, was inserted in a well-sealed plastic drum containing 10 liters of dearomatized hydrocarbon solvent. The plastic drum was then kept on a reciprocating shaking machine for 5 min to allow proper mixing of the $H_2S$ gas. 500 mL of the $H_2S$ containing dearomatized hydrocarbon solvent were then transferred to first tin metal bottle and sealed with inner and outer caps. The tin metal bottle was then kept in a water bath at 60° C. for two hours. After two hours, the tin metal bottle was taken out and cooled down to room temperature under running tap water and kept aside. An $H_2S$ detecting tube (Drager tube, with typical detection limit ranging from 100 to 70 000 ppm by weight) was inserted in a rubber cork through a hole having the same diameter as the detecting tube. The sealed ends of the $H_2S$ detecting tube were opened with an appropriate opener, one end of the tube being attached to Drager pump. The inner and outer caps of the tin metal bottles were opened and very quickly the rubber cork with $H_2S$ detector tube was inserted inside the opening of the tin metal bottle. The $H_2S$ gas in the vapor phase of the tin metal bottle was then pulled through the $H_2S$ measuring tube using Drager pump attached at the other end of the tube. The detector tube was removed after complete decompression of the pump. $H_2S$ concentration was read from the tubes calibration scale (typically color change from colorless to brown). This reading was noted as a reference Blank reading of $H_2S$ amount.

Further, remaining $H_2S$ containing dearomatized hydrocarbon solvent was transferred into other tin metal bottles, each with 500 mL of the dearomatized hydrocarbon, all bottles being pre-charged with the $H_2S$ scavengers at different ratios of scavenger against $H_2S$, based on the Blank reading. Typical $H_2S$:scavenger ratios employed were 1:1, 1:0.8, 1:0.6, 1:0.4, 1:0.2 and 1:0.1. All the metal bottles were kept in a water bath for two hours at 60° C. Similar protocol was employed to measure the $H_2S$ in the vapor phase of all the bottles as used to make the Blank reading. The difference between the Blank $H_2S$ concentration and $H_2S$ concentration observed with different concentrations of the scavenging products and formulations are noted as % scavenging. A higher % Scavenging with lower concentration of the scavenging product is considered as better $H_2S$ scavenger for the set of experiment.

TABLE 1 scavenging compositions (in wt % based on the total weight of the composition)

| $H_2S$ scavenging composition | MBO (wt %) | Synergistic additive (wt % of active ingredient) Total PIBSI | Solvent (wt %) xylene |
|---|---|---|---|
| C1 (comparative) | 50 | 0 | 50 |
| C2 (comparative) | 100 | 0 | 0 |
| I1 | 50 | 4.5-5.5 | 44.5-45.5 |
| I2 | 50 | 2.25-2.75 | 47.25-47.75 |
| I3 | 45 | 2.25-2.72 | 52.25-52.75 |

Table 2 below shows the percentage of $H_2S$ reduction based on the measured $H_2S$ amount in vapour phase after treatment with comparative MBO compositions (C1 and C2) and $H_2S$ scavenging compositions of the invention (11, 12 and 13).

TABLE 2

Scavenging efficiency (% of $H_2S$ reduction) of the scavenging compositions

| $H_2S$ scavenging composition | Sample1 (blank) | Sample2 [1:0.1] | Sample3 [1:0.2] | Sample4 [1:0.4] | Sample5 [1:0.6] | Sample6 [1:0.8] | Sample7 [1:1] |
|---|---|---|---|---|---|---|---|
| C1 (50% MBO) | 0 | 3 | 12 | 43 | 74 | 92 | 100 |
| C2 (100% MBO) | 0 | 15 | 45 | 93 | 100 | 100 | 100 |
| I1 (50% MBO; 4.5-5% additive) | 0 | 25 | 40 | 74 | 100 | 100 | 100 |
| I2 (50% MBO; 2.25-2.5% additive) | 0 | 25 | 38 | 73 | 98 | 100 | 100 |
| I3 (45% MBO; 2.25-2.5% addtive) | 0 | 8 | 17 | 67 | 84 | 99 | 100 |

The protocol of measurement was repeated three times with each scavenging composition and the indicated percentage was calculated based on the average of the measurements.

Example 2: Measurement of $H_2S$ Scavenging Ability of the Scavenging Compositions of the Invention Under Modified ASTM D-5705 Conditions, as Detailed in Example 1

Table 1 below summarizes the scavenging compositions that were tested. The synergistic additive used in Examples 11, 12 and 13 according to the invention was the reaction product of polyisobutyl succinic anhydride with tetraethylene pentamine, having typically a Mw of 2535 Daltons, a Mn of 1065 Daltons and a polydispersity index of 2, 4. This product is available from Total ACS under the commercial name Total PIBSI in the form of a solution with an active content of about 45 to 55% w/w, i.e. comprising 45-55 wt % additive and 45-55 wt % solvent. The concentration of additive reported in Table 1 corresponds to the actual amount of active ingredient in the scavenging composition. As such, composition 11 comprises 10 wt % of additive solution at 45-55 wt % of active content, which correspond to 4.5-5.5 wt % of active ingredient in the scavenging composition.

The results in Table 2 clearly show that the scavenging compositions of the present invention are much more efficient than the scavenging compositions of the prior art.

If we refer for example to sample 4 wherein the weight ratio $H_2S$:scavenging composition is 1:0.4, we can observe that 74% of the $H_2S$ have been scavenged with the scavenging composition 11 according to the invention and even 73% of the $H_2S$ with the scavenging composition 12 comprising twice less additive than 11, whereas only 43% of the $H_2S$ have been scavenged with the scavenging composition C1 of prior art.

Example 3: Measurement of $H_2S$ Scavenging Ability of the Synergistic Additive Under Modified ASTM D-5705 Conditions, as Detailed in Example 1

The synergistic additive of the invention was also tested alone for its ability to scavenge hydrogen sulphide using the modified ASTM D-5705 method. The aim was to determine the contribution of the synergistic additive to the total scavenging ability of the composition.

The protocol of measurement was repeated three times with each composition of synergistic additive and the indicated percentage was calculated based on the average of the measurements.

Table 3 below shows the percentage of $H_2S$ reduction based on the measured $H_2S$ amount in vapour phase after treatment with the additive in a solvent. The tested comparative composition C3 comprises 5% by weight of active ingredient of the additive Total PIBSI and 95% by weight of xylene. Similarly C4 comprise 10% by weight of active ingredient of the additive Total PIBSI and 90% by weight of xylene.

TABLE 3

| % Scavenging efficiency (% of $H_2S$ reduction) of the synergistic additive | | | | | | | |
|---|---|---|---|---|---|---|---|
| synergistic additive composition | Sample1 (blank) | Sample2 [1:0.1] | Sample3 [1:0.2] | Sample4 [1:0.4] | Sample5 [1:0.6] | Sample6 [1:0.8] | Sample7 [1:1] |
| C3 (5% additive) | 0 | 0 | 0 | 0 | 0 | 0 | 0 |
| C4 (10% additive) | 0 | 0 | 0 | 0 | 0 | 0 | 0 |

The results in Table 3 clearly show that the synergistic additive has no direct effect on the scavenging of hydrogen sulphide. This confirms that said additive cannot itself scavenge $H_2S$ but has a boosting effect when used together with an $H_2S$ scavenging compound.

Example 4: Measurement of $H_2S$ Scavenging Ability of the Scavenging Compositions of the Invention Under Modified ASTM D-5705 Conditions The following protocol has been followed:

ASTM D-5705 is recommended for measurement of Hydrogen sulfide in a vapor phase above the residual fuel oils. Performance evaluation of the various products and formulations developed as Hydrogen Sulfide Scavengers were evaluated using modified ASTM D-5705 test method.

In a typical experiment, 1 liter tin metal bottles with silicon septa were used to prepare and hold in the two test media:

Test media 1: a dearomatized hydrocarbon solvent having an initial boiling point higher than 120° C., a final boiling point lower than 250° C. (the difference between the final boiling point and the initial boiling point ranges from 20 to 35° C.) and a flash point above 65° C. with aromatic content less than 0.1% wt and a paraffin content of more than 75% wt, Test media 2: a dearomatized hydrocarbon solvent having an initial boiling point higher than 120° C., a final boiling point higher than 250° C. (the difference between the final boiling point and the initial boiling point ranges from 40 to 50° C.) and a flash point above 100° C. with aromatic content less than 0.05% wt and a paraffin content of more than 75% wt.

In a representative experimental set, a defined amount of $H_2S$ saturated hydrocarbon solvent, typically between 2000 and 7000 ppm by weight of $H_2S$, was injected in 1 liter tin metal bottle pre-filled with 500 ml of dearomatized hydrocarbon solvent through the silicon septa fixed at the opening of the bottle using micro-syringe. The metal bottle was then kept on a reciprocating shaking machine for 5 min to allow proper mixing of the $H_2S$ gas. The tin metal bottle was then kept in a water bath at 60° C. for two hours. After two hours, the tin metal bottle was taken out and cooled down to room temperature under running tap water and kept aside. An $H_2S$ detecting tube (Drager tube, with typical detection limit ranging from 100 to 70 000 ppm by weight) was inserted in a rubber cork through a hole having the same diameter as the detecting tube. The sealed ends of the $H_2S$ detecting tube were opened with an appropriate opener, one end of the tube being attached to Drager pump. The silicon septa mounted at the opening of the tin metal bottles was removed and very quickly the rubber cork with $H_2S$ detector tube was inserted inside the opening of the tin metal bottle. The $H_2S$ gas in the vapor phase of the tin metal bottle was then pulled through the $H_2S$ measuring tube using Drager pump attached at the other end of the tube. The detector tube was removed after complete decompression of the pump. $H_2S$ concentration was read from the tubes calibration scale (typically color change from colorless to brown). This reading was noted as a reference Blank reading of $H_2S$ amount.

Further, same amount of $H_2S$ containing dearomatized hydrocarbon solvent was injected into other tin metal bottles, which are pre-filled with 500 mL of the dearomatized hydrocarbon, and $H_2S$ scavengers at different ratios of scavenger against $H_2S$, based on the Blank reading. Typical $H_2S$:scavenger ratios employed were 1:1, 1:0.8, 1:0.6, 1:0.4, 1:0.2 and 1:0.1. All the metal bottles were kept in a water bath for two hours at 60° C. Similar protocol was employed to measure the $H_2S$ in the vapor phase of all the bottles as used to make the Blank reading. The difference between the Blank $H_2S$ concentration and $H_2S$ concentration observed with different concentrations of the scavenging products and formulations are noted as % scavenging. A higher % Scavenging with lower concentration of the scavenging product is considered as better $H_2S$ scavenger for the set of experiment.

The protocol of measurement was repeated three times with each scavenging composition and the indicated percentage was calculated based on the average of the measurements.

Table 4 below summarizes the scavenging compositions that have been tested. The synergistic additive used in Examples 14, 15 and 16 is identical to the additive used in example 2, except that the solvent xylene has been replaced by the solvent butyl carbitol. The concentration of additive reported in Table 4 corresponds to the actual amount of active ingredient in the scavenging composition. As such, composition 14 comprises 5 wt % of additive solution at 45-55 wt % of active content, which correspond to 2.25-2.75 wt % of active ingredient in the scavenging composition.

TABLE 4

| scavenging compositions (in wt % based on the total weight of the composition) | | | |
|---|---|---|---|
| $H_2S$ scavenging composition | MBO (wt %) | Synergistic additive (wt % of active ingredient) Total PIBSI | Solvent (wt %) Butyl carbitol |
| C5 | 50 | 0 | 50 |
| I4 | 50 | 2.25-2.75 | 47.25-47.75 |
| I5 | 50 | 1.13-1.38 | 48.87-48.62 |
| I6 | 50 | 0.45-0.55 | 49.55-49.45 |

Table 5 below shows the percentage of $H_2S$ reduction based on the measured $H_2S$ amount in vapour phase after treatment with a comparative MBO composition (C5) and $H_2S$ scavenging compositions of the invention (14, 15 and 16).

TABLE 5

| Scavenging efficiency (% of $H_2S$ reduction) of the scavenging compositions | | | | | | | |
|---|---|---|---|---|---|---|---|
| $H_2S$ scavenging composition in Test media | Sample1 (blank) | Sample2 [1:0.1] | Sample3 [1:0.2] | Sample4 [1:0.4] | Sample5 [1:0.6] | Sample6 [1:0.8] | Sample7 [1:1] |
| C5 in Test Media 1 | 0 | 5 | 12 | 43 | 74 | 92 | 100 |
| C5 in Test Media 2 | 0 | 10 | 26 | 78 | 85 | 100 | 100 |
| I4 in Test Media 1 | 0 | 25 | 40 | 74 | 100 | 100 | 100 |
| I4 in Test Media 2 | 0 | 30 | 50 | 100 | 100 | 100 | 100 |
| I5 in Test Media 1 | 0 | 25 | 38 | 73 | 98 | 100 | 100 |
| I6 in Test Media 1 | 0 | 20 | 32 | 68 | 96 | 100 | 100 |

The results in Table 5 clearly show that the scavenging compositions of the present invention are much more efficient than the scavenging compositions of the prior art, in both hydrocarbon streams that have been used as test media.

Example 5: Measurement of $H_2S$ Scavenging Ability of the Scavenging Compositions of the Invention Under Modified ASTM D-5705 Conditions Similar experiments as example 4 have been performed, except that another synergistic additive has been used and the solvent used is xylene. The synergistic additive used is a commercially available additive solution comprising the reaction product of polyisobutyl succinic anhydride with 2-Propanol, 1-[(3-aminopropyl)amino] followed by quaternization (with halide for example). The concentration of additive reported in Table 6 corresponds to the actual amount of active ingredient in the scavenging composition. As such, composition 17 comprises 5 wt % of additive solution at about 51 wt % of active content, which correspond to 2.55 wt % of active ingredient in the scavenging composition.

Table 6 below summarizes the scavenging compositions that have been tested.

TABLE 6

| scavenging compositions (in wt % based on the total weight of the composition) | | | |
|---|---|---|---|
| $H_2S$ scavenging composition | MBO (wt %) | Synergistic additive (wt % of active ingredient) | Solvent (wt %) xylene |
| C1 (comparative) | 50 | 0 | 50 |
| I7 | 50 | 2.55 | 47.45 |

TABLE 6-continued

| scavenging compositions (in wt % based on the total weight of the composition) | | | |
|---|---|---|---|
| $H_2S$ scavenging composition | MBO (wt %) | Synergistic additive (wt % of active ingredient) | Solvent (wt %) xylene |
| I8 | 50 | 1.28 | 48.72 |
| I9 | 50 | 0.51 | 49.49 |

Table 7 below shows the percentage of $H_2S$ reduction based on the measured $H_2S$ amount in vapour phase after treatment with comparative MBO composition (C1) and $H_2S$ scavenging compositions of the invention (I7, I8 and I9).

TABLE 7

| Scavenging efficiency (% of $H_2S$ reduction) of the scavenging compositions | | | | | | | |
|---|---|---|---|---|---|---|---|
| $H_2S$ scavenging composition in Test media | Sample1 (blank) | Sample2 [1:0.1] | Sample3 [1:0.2] | Sample4 [1:0.4] | Sample5 [1:0.6] | Sample6 [1:0.8] | Sample7 [1:1] |
| C1 in Test Media 1 | 0 | 5 | 12 | 43 | 74 | 92 | 100 |
| C1 in Test Media 2 | 0 | 10 | 26 | 78 | 85 | 100 | 100 |
| I7 in Test Media 1 | 0 | 32 | 45 | 76 | 100 | 100 | 100 |
| I7 in Test Media 2 | 0 | 35 | 54 | 92 | 100 | 100 | 100 |
| I8 in Test Media 1 | 0 | 29 | 42 | 75 | 98 | 100 | 100 |
| I9 in Test Media 1 | 0 | 25 | 38 | 71 | 96 | 100 | 100 |

The results in Table 7 clearly show that the scavenging compositions of the present invention are much more efficient than the scavenging compositions of the prior art, in both hydrocarbon streams that have been used as test media.

The invention claimed is:

1. A composition for scavenging hydrogen sulphide and mercaptans in hydrocarbon streams, said composition comprising an oxazolidine compound and an additive, the additive being the reaction product of a compound (A) with a compound (B), optionally followed by a quaternization reaction of the reaction product of (A) and (B) with a compound (C), wherein the weight ratio of oxazolidine compound(s) to said additive(s) ranges from 1 to 100, wherein:

Compound (A) is a polyisobutenyl succinic anhydride (PIBSA),

Compound (C) is a quaternizing agent, and

Compound (B) is selected from:

primary polyamines of formula (II):

$$H_2N—[(CHR^3—(CH_2)_p—CHR^4)_q—NH]_m—H$$

wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1;

or from the group consisting of: N,N-dimethylaminopropylamine, N,N,N-tris(aminoethyl)amine, N,N-dibutylaminopropylamine, N,N-diethylaminopropylamine, N,N-dimethylaminoethylamine, 1-(3-aminopropyl) imidazole, 4-(3-aminopropyl) morpholine, 1-(2-aminoethyl)piperidine, 3,3-diamino-N-methyldipropylamine, and $31^3$-bisamino(N,N-dimethylpropylamine), and N'-(3-(dimethylamino)propyl)-N,N-dimethyl-1,3-propanediamine.

2. The composition according to claim 1, wherein the quaternizing agent (C) is selected from the group constituted by the dialkyl sulphates, the carboxylic acid esters; the alkyl halides, the benzyl halides, the hydrocarbon carbonates, and the hydrocarbon epoxides optionally mixed with an acid, alone or in a mixture.

3. The composition according to claim 1, wherein said additive comprises: compound (i) the reaction product of a compound (A) with a compound (B).

4. The composition according to claim 1, wherein the composition comprises from 19 to 99% wt of oxazolidine compound(s) and from 1 to 50% wt of said additive(s), based on the total weight of the composition.

5. The composition according to claim 1, wherein the weight ratio of oxazolidine compound(s) to said additive(s) ranges from 1 to 50.

6. The composition according to claim 1, further comprising a solvent.

7. The composition according to claim 6, wherein the solvent is present in an amount ranging from 1 to 80% wt, based on the total weight of the composition.

8. The composition according to claim 1, comprising:

from 19 to 80% wt of oxazolidine compound(s), from 1 to 30% wt of said additive(s), and from 1 to 80% wt of solvent(s), based on the total weight of the composition.

9. Process for improving the efficiency of an oxazolidine compound for scavenging hydrogen sulphide and/or mercaptans in hydrocarbon streams, the process comprising a step of adding the additive defined in claim 1 in an oxazolidine compound, wherein the weight ratio of oxazolidine compound to said additive ranges from 1 to 100.

10. Hydrocarbon stream comprising hydrocarbons and a composition according to claim 1.

11. Hydrocarbon stream according to claim 10, wherein the hydrocarbons are selected from crude oil, fuel oil, fuel, Light Petroleum Gas and natural gas.

12. A method for scavenging hydrogen sulphide and/or mercaptans in hydrocarbon streams, comprising contacting the hydrocarbon stream with the composition according to claim 1.

13. The composition according to claim 1, wherein compound (B) is selected from primary polyamines of formula (II).

14. A composition for scavenging hydrogen sulphide and mercaptans in hydrocarbon streams, said composition comprising an oxazolidine compound and an additive, the additive being the reaction product of a compound (A) with a compound (B), followed by a quaternization reaction of the reaction product of (A) and (B) with a compound (C), wherein the weight ratio of oxazolidine compound(s) to said additive(s) ranges from 1 to 100, wherein:

Compound (A) is a hydrocarbyl-substituted acylating agent,

Compound (C) is a quaternizing agent,

Compound (B) is an alkanolamine comprising one hydroxyl function, one primary amine function, and one tertiary function and from 4 to 16 carbon atoms.

15. The composition according to claim 14, wherein:

Compound (A) is a polyisobutenyl succinic anhydride (PIBSA),

Compound (B) is an alkanolamine comprising one hydroxyl function, one primary amine function and one tertiary amine function and from 4 to 16 carbon atoms, Compound (C) is a quaternizing agent.

16. A composition for scavenging hydrogen sulphide and mercaptans in hydrocarbon streams, said composition comprising an oxazolidine compound and an additive, the additive comprising:

(i) a reaction product of a compound (A) with a compound (B), wherein:

Compound (A) is a polyisobutenyl succinic anhydride (PIBSA),

Compound (B) is a nitrogen-containing compound formula (II):

$$H_2N—[(CHR^3—(CH_2)_p—CHR^4)_q—NH]_m—H$$

wherein:

$R^3$ and $R^4$, which are identical or different, represent hydrogen or an alkyl or alkenyl group comprising from 1 to 4 carbon atoms, q is an integer varying from 1 to 3, m is an integer varying from 1 to 10 and p is an integer equal to 0 or 1, or (ii) a reaction product of a compound (A) with a compound (B), followed by a quaternization reaction of the reaction product of (A) and (B) with a compound (C), wherein:

Compound (A) is a polyisobutenyl succinic anhydride (PIBSA),

Compound (B) is an alkanolamine comprising one hydroxyl function, one primary amine function and one tertiary amine function and from 4 to 16 carbon atoms, Compound (C) is a quaternizing agent, wherein the composition comprises from 19 to 99% wt of oxazolidine compound(s) and from 1 to 50% wt of said additive(s), based on the total weight of the composition, and wherein the oxazolidine compound is selected from bisoxazolidines having a structure of formula (I):

(I)

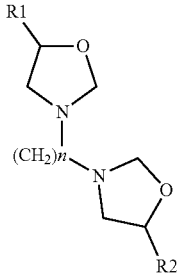

wherein n is an integer ranging from 1 to 6; and

R1 and R2, identical or different, are selected from a hydrogen atom and a linear, branched or cyclic alkyl or alkenyl groups having from 1 to 6 carbon atoms.

* * * * *